US005201140A

United States Patent [19]

Voorhis

[11] Patent Number: 5,201,140

[45] Date of Patent: Apr. 13, 1993

[54] REMOTE CHRISTMAS TREE WATERING APPARATUS

[76] Inventor: Donald P. Voorhis, 2412 Wembly, Troy, Mich. 48084

[21] Appl. No.: 626,011

[22] Filed: Dec. 12, 1990

[51] Int. Cl.[5] ..... A47G 7/02

[52] U.S. Cl. ..... 47/40.5; 47/79

[58] Field of Search ..... 220/DIG. 6, 307, 203; 47/40.5, 48.5, 79

[56] References Cited

U.S. PATENT DOCUMENTS

| | | | |
|---|---|---|---|
| 114,638 | 5/1871 | Booher | 47/66 |
| 1,117.474 | 11/1914 | Benning . | |
| 1,453,401 | 5/1923 | Mattson . | |
| 2,183,970 | 12/1939 | Meissl . | |
| 2,799,121 | 7/1957 | Modeweg . | |
| 2,938,304 | 5/1960 | Thomas et al. . | |
| 2,983,076 | 5/1961 | Merrill | 47/70 |
| 3,137,969 | 6/1964 | Sokol . | |
| 3,262,612 | 7/1966 | Tabor | 220/307 |
| 3,469,342 | 9/1969 | Morris . | |
| 3,505,760 | 4/1970 | Ambrose . | |
| 3,697,026 | 10/1972 | Hambrick . | |
| 3,802,007 | 4/1974 | Dolan, Jr. . | |
| 4,085,546 | 4/1978 | Haller | 47/79 |
| 4,087,938 | 5/1978 | Koch . | |
| 4,291,836 | 9/1981 | Chen-Hesung | 47/48.5 |
| 4,347,687 | 9/1982 | Sibbel | 47/79 |
| 4,610,356 | 9/1986 | Porter | 47/40.5 |
| 4,653,224 | 3/1987 | Weckesser . | |
| 4,739,898 | 4/1988 | Brown | 220/203 |
| 4,825,587 | 5/1989 | Stancil | 47/40.5 |
| 4,930,252 | 6/1990 | Krause | 47/40.5 |

*Primary Examiner*—Henry E. Raduazo

*Attorney, Agent, or Firm*—Harness, Dickey & Pierce

[57] ABSTRACT

Disclosed is a remote Christmas tree watering system. Incorporated in the system is a traditional Christmas tree stand having a chamber, a plurality of support legs, and means, such as eye bolts for holding the Christmas tree within the chamber. The chamber further includes a spigot at its bottom surface for accepting a hose. The hose is attached at its other end to a reservoir remote from the Christmas tree stand. By this, the remote reservoir can continuously provide water to the Christmas tree stand, without the need to climb under the Christmas tree. In addition, a decorative outer enclosure, such as a gift wrapped box, can be positioned around the remote reservoir to add to the aesthetically pleasing nature of the scene. Further, the reservoir can be completely emptied and reconnected to the Christmas tree stand to drain the remaining water from the Christmas tree stand when it is time to remove the Christmas tree from the Christmas tree location, thus obviating the known drawbacks of carrying a Christmas tree stand with water in it. In a second preferred embodiment, the hose attached to the spigot is attached to the upper end of the chamber of the Christmas tree stand such that a visible indication of the water level within the stand is given by viewing the water level within the hose, the hose being clear.

28 Claims, 3 Drawing Sheets

FIG 4
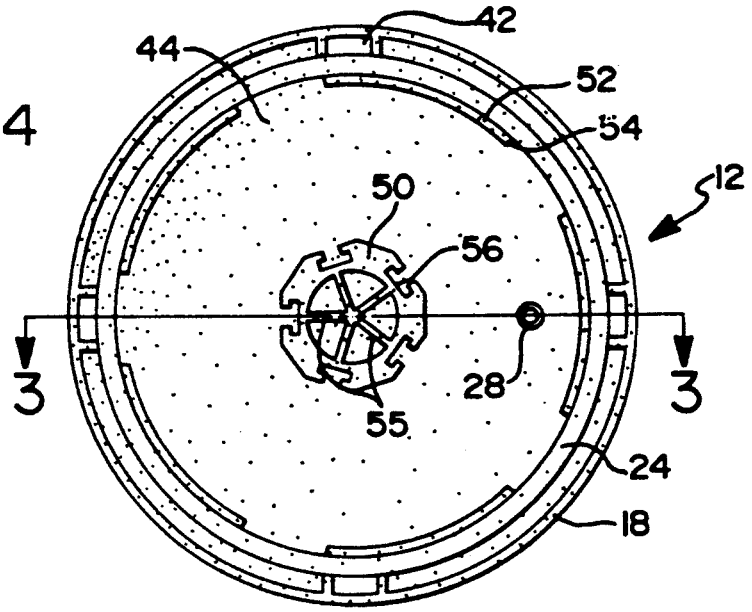
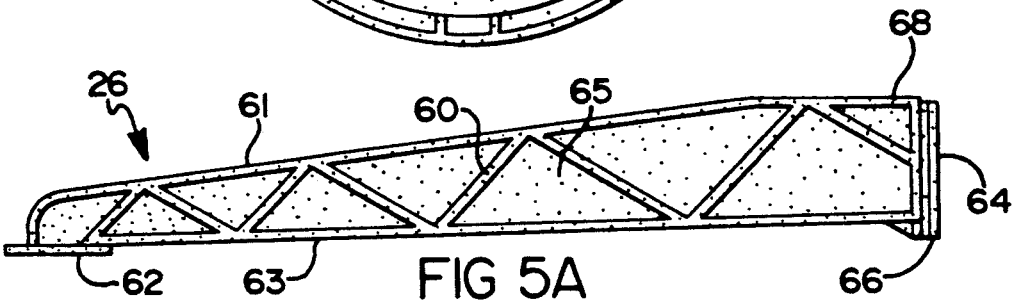
FIG 5A
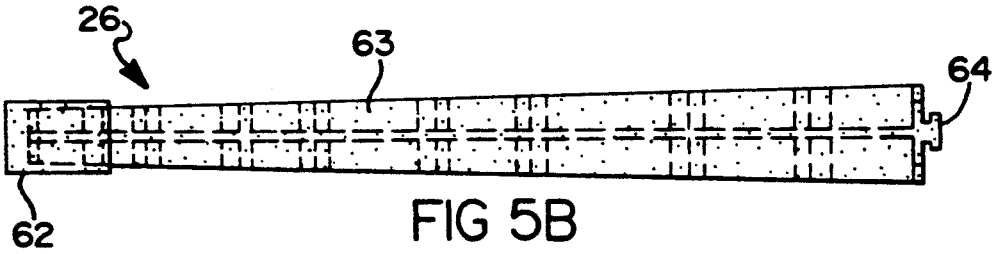
FIG 5B
FIG 6
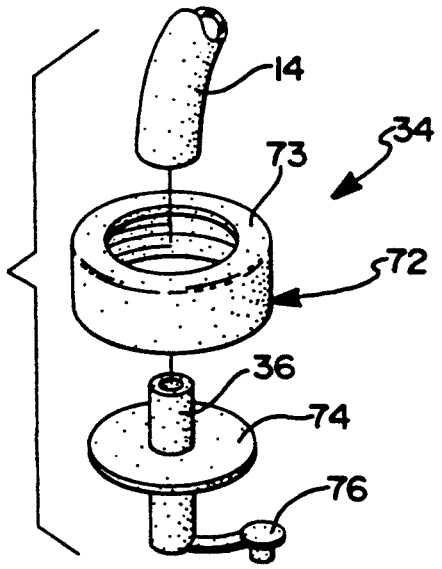

FIG 7A
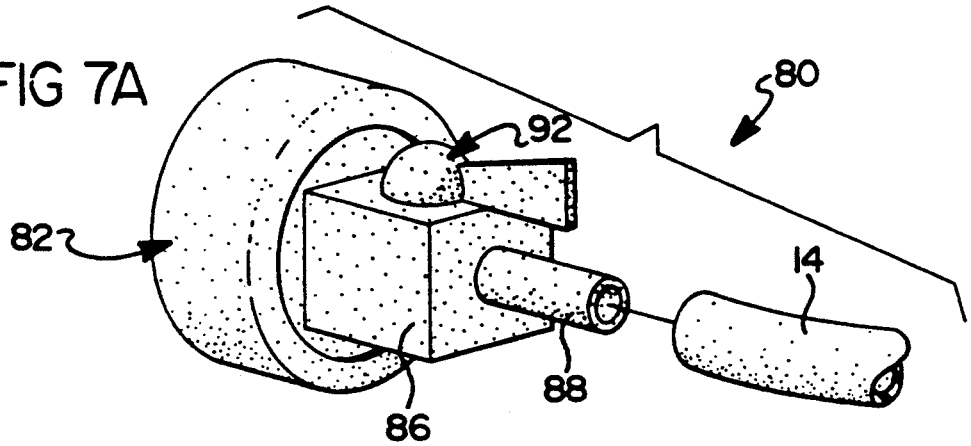
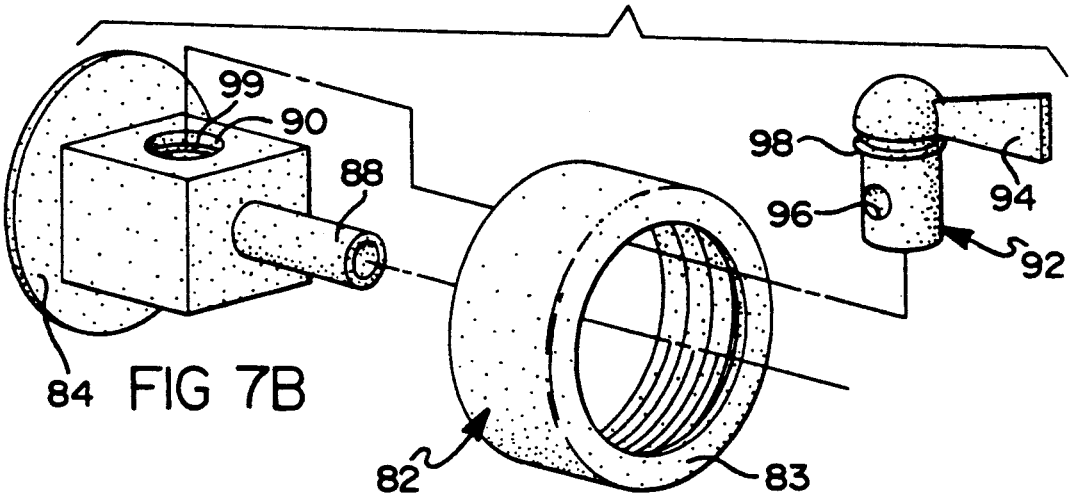
FIG 7B
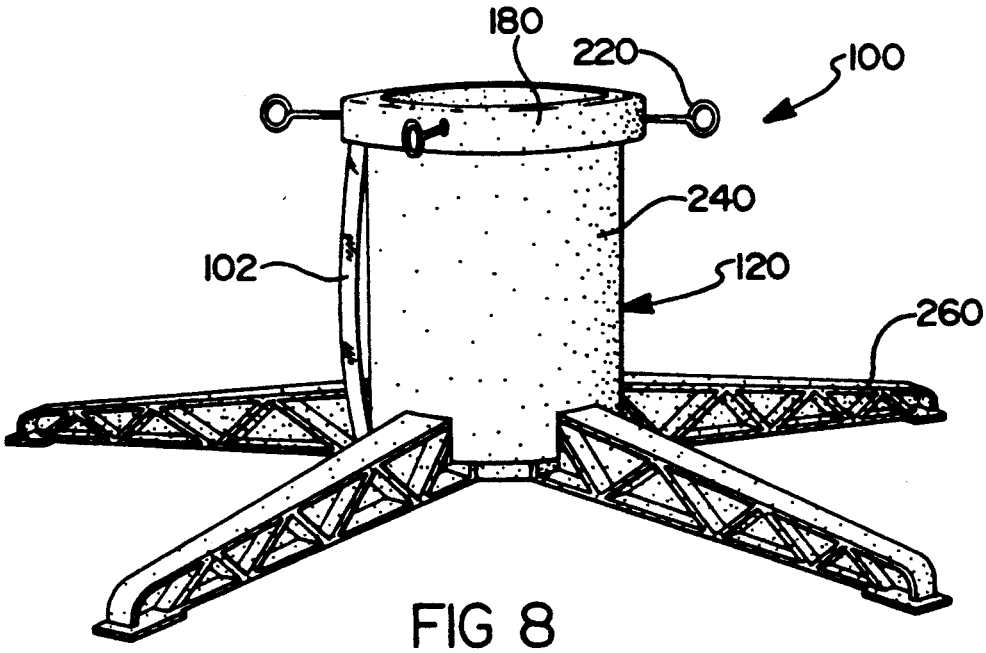
FIG 8

REMOTE CHRISTMAS TREE WATERING APPARATUS

BACKGROUND OF THE INVENTION

1. Field of the Invention

This invention relates generally to a remote watering device, and more specifically, to a remote watering device for providing water to a Christmas tree stand.

2. Description of the Related Art

Christmas tree stands which support and provide water for a Christmas tree removed from its natural environment are known in the art. Generally, in a family setting, a Christmas tree stand will support the Christmas tree in a particular room of a house, many times in a somewhat confined location. In keeping with the holiday decorative spirit, certain coverings are generally placed around the Christmas tree stand, as well as a variety of decoratively wrapped gifts or packages. Further, the Christmas tree requires a substantial amount of water to sustain it in a healthy and pristine condition. Since the water holding capacity of the tree stand is limited, it is a necessity that the tree stand be periodically filled with water. Herein a number of problems arise.

With the prior art tree stands, it was necessary to climb under the tree, removing whatever obstacle was in the way, i.e., packages and the like, and virtually blindly fill the Christmas tree stand with water from a portable watering device. This procedure provided somewhat of a undesirable task in that it was generally difficult to get to the tree stand itself around the presents, gifts, packages and tree branches, etc. In addition, tree branches were broke, ornaments were disturbed, knocked off or broken, pine needles fell and water was generally spilled on the floor and everything else around the tree each time the tree was watered.

Because of these undesirable characteristics of watering the Christmas tree, many times this task would be avoided, sometimes causing the water in the Christmas tree stand to be completely drained, and thus, creating a fire hazard from a dry Christmas tree, as well as an unpleasant looking tree. At the end of the holiday season, the Christmas tree along with the Christmas tree stand was generally removed by carrying the Christmas tree and stand through the house to an outdoor location. Because of the size and awkwardness of the Christmas tree itself, a substantial amount of water generally spilled from the Christmas tree stand if any was remaining.

What is needed then is an apparatus for remotely providing water to the Christmas tree stand, and remotely removing water from the stand at the end of the holiday season in order to avoid the above described drawbacks of providing water directly to the Christmas tree stand. It is, therefore, an object of the present invention to provide such an apparatus.

SUMMARY OF THE INVENTION

Disclosed is a remote Christmas tree watering apparatus comprising a traditional Christmas tree stand including means for securing a Christmas tree to the stand, and a cup for accepting water surrounding the lower trunk portion of the Christmas tree. Provided at a lower location of the Christmas tree stand is a spigot in communication with the cup. A hose is attached at one end to the spigot, and at an opposite end to a remote reservoir which is filled with water. The hose is of such a length so that the remote reservoir can be positioned a substantial distance away from the Christmas tree stand. By this arrangement, the reservoir supplies water through the hose to the Christmas tree stand. In addition, a decorative outer casing, such as a wrapped gift having a false bottom, can be positioned over the remote reservoir to provide an aesthetically pleasing appearance.

When the reservoir is empty, it can be detached from the hose and taken to a water source, such as a sink, and refilled at this location. The end of the hose which was attached to the remote reservoir includes means for preventing water from the Christmas tree stand to flow back through the hose and onto the floor. The hose itself is readily concealable by other traditional Christmas type decorations positioned around the Christmas tree. At the end of the holiday season, when the Christmas tree is to be removed from its Christmas location, the remote reservoir can be carried to a waste location and emptied. The hose is then reattached to the remote reservoir such that the remaining water in the Christmas tree stand is drawn back through the hose into the remote reservoir. By this, there is substantially no water left in the Christmas tree stand to be spilled onto the floor when removing the Christmas tree from the Christmas location.

A second preferred embodiment includes the traditional Christmas tree stand, as above with the spigot communicating with the cup of the Christmas tree stand, but in which the hose attached to the spigot is attached at an opposite end to an upper portion of the Christmas tree stand. By this, if the hose is clear, a visible indication of the water within the Christmas tree stand can be ascertained by viewing the water level within the hose.

By the above described invention, the Christmas tree is safely, conveniently and easily watered without the traditional problems of pouring water in the Christmas tree stand itself as described above.

Additional objects, advantages, and features of the present invention will become apparent from the following description and appended claims, taken in conjunction with the accompanying drawings.

BRIEF DESCRIPTION OF THE DRAWINGS

FIG. 4 is a bottom view of the Christmas tree stand;

FIG. 5A is a side view of one of the legs of the Christmas tree stand;

FIG. 5B is a bottom view of one of the legs of the Christmas tree stand;

FIG. 6 is a blown-up perspective view of a first embodiment of a valve included with the remote watering assembly;

FIG. 7A is a perspective view of the second embodiment of a valve for use with the remote reservoir;

FIG. 7B is a blown-up perspective view of the valve of FIG. 7A; and

FIG. 8 is a Christmas tree stand according to a second preferred embodiment of the present invention.

DETAILED DESCRIPTION OF THE INVENTION

The following description of the preferred embodiment is merely exemplary in nature and is in no way intended to limit the invention or its applications or uses.

Figure 1:
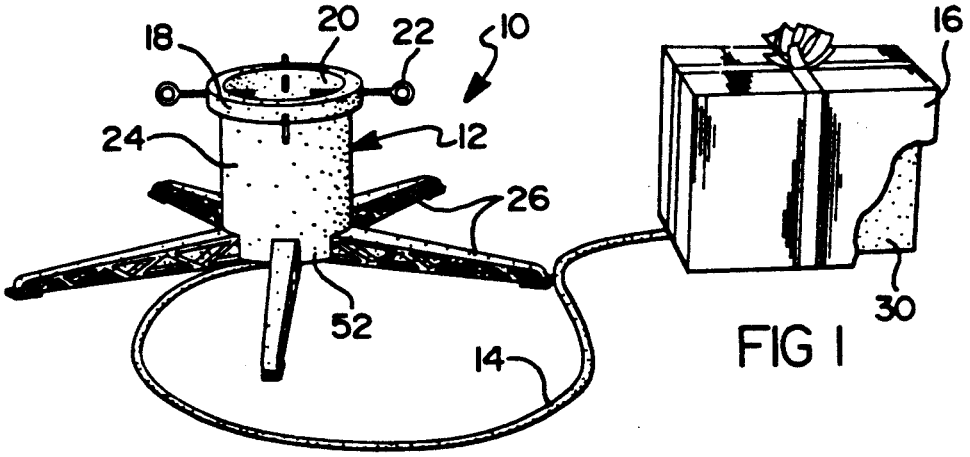
FIG. 1 is a perspective view of a Christmas tree stand including a remote watering apparatus.

FIG. 1 discloses a remote Christmas tree watering system, shown generally at 10. System 10 includes a Christmas tree stand 12 attached to a remote watering reservoir 30 by means of a pliable hose 14. Reservoir 30 is concealed by a decorative outer enclosure 16, such as a gift wrapped box. Enclosure 16 has a false bottom such that it can be readily and easily positioned on and removed from reservoir 30. Hose 14 extends through an opening in outer enclosure 16, and is attached at one end to a spout in reservoir 30 (see FIG. 2). Hose 14 is attached at its other end to a spigot in tree stand 12 see FIG. 3).

Tree stand 12 is comprised of a cylindrically shaped cup 24 having an upper lip 18 completely encircling an opening 20 defining an inner chamber within cup 24. Cup 24 can take on other appropriate shapes satisfying other designs. A plurality of eye bolts 22 are threaded through lip 18 into the interior of cup 24 proximate opening 20, as shown. At a lower portion of cup 24, opposite lip 18, is a plurality of detachable legs 26 (See FIG. 5). In this embodiment, tree stand 12 includes five detachable legs 26, however, less or more legs can be incorporated without departing from the spirit of the invention. The diameter of cup 24 is approximately 6½ inches, but can take on any appropriate diameter. Eye bolts 22 are engaged to secure a Christmas tree (not shown) within tree stand 12, as is well known in the art. All of tree stand 12, hose 14 and reservoir 30 are generally composed of a moldable plastic material.

Figure 2:
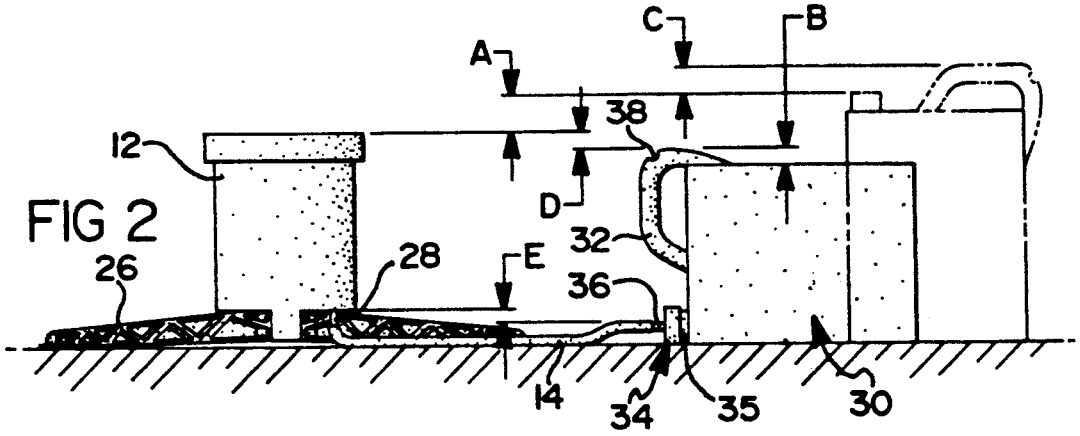
FIG. 2 is a side view of the Christmas tree stand showing the remote reservoir in a side position, and an upright position in phantom.

The operation of the remote Christmas tree watering system 10 will be better understood by viewing FIG. 2. FIG. 2 is a side view of system 10 without the decorative outer enclosure 16. As can be seen, hose 14 is attached to a rigid spigot 28 extending from a bottom surface of cup 24. The inner diameter of hose 14 is slightly less than the outer diameter of spigot 28 such that pliable hose 14 can be manually forced onto rigid spigot 28 in a friction-fit, and remain attached against reasonable forces. As stated above, hose 14 is attached at its other end to reservoir 30. Reservoir 30 is shown in a side position attached to hose 14, and in an upright position in phantom. Reservoir 30 is generally a blow molded plastic container of approximately 2½ gallons volume, and includes a handle 32 having a pressure equalizing orifice 38 and a fill spout 35. A cap assembly 34 is threadably engaged onto fill spout 35. Cap assembly 34 includes a spigot 36 for accepting the end of hose 14 opposite tree stand 12 in the same manner as with spigot 28. When reservoir 30 is on its side and attached to hose 14, as shown, reservoir 30 provides a means by which tree stand 12 can be continuously filled with water from a remote location, as described below.

In operation, a Christmas tree is secured to Christmas tree stand 12 at a convenient location, such as a garage. Initially, the hose 14 is force fitted onto the spigot 28. Eye bolts 22 can then be used to secure the Christmas tree to Christmas tree stand 12, as is well known in the art. The Christmas tree within stand 12 will then be positioned at a desirable location. Reservoir 30, with cap assembly 34 removed, will then be filled at a sink or washtub with water. Reservoir 30 will be filled in an upright position and set in this position at a remote location from tree stand 12 within reach of hose 14, as shown in phantom. Cap assembly 34 will either be threaded onto spout 35 while it is at the sink location, or can be threaded onto spout 35 while it is at the remote location from tree stand 12. Hose 14 will generally already be positioned on spigot 36 if ca assembly 34 is threaded onto spout 35 at the remote location, however, hose 14 can be positioned onto spigot 36 after cap assembly 34 is threaded onto spout 35.

Once cap assembly 34 is threaded onto fill spout 35, reservoir 30 will then be positioned in its side position, as shown in FIG. 2. Orifice 38 in handle 32 is a pressure equalizing orifice, which will be described below. Since reservoir 30 is generally a blow molded plastic, handle 32 is hollow, and open to the interior of reservoir 30. As is shown in FIG. 2, however, water will not leak out of orifice 38 while reservoir 30 is either in an upright position or in a side position. This is apparent from dimension C showing the top of fill spout 35 at a lower position than orifice 38, and also, by dimension B showing orifice 38 at a position higher than the top of reservoir 30 in its side position.

When tree stand 12, including the Christmas tree, is first positioned in a desirable location cup 24 is empty. With reservoir 30 in an upright position, as shown in phantom, water is unable to travel into hose 14 since spigot 36 is above the water level in reservoir 30. Once reservoir 30 is connected to hose 14 and positioned on its side as shown in FIG. 2, spigot 36 is below the water level in reservoir 30, and thus water within reservoir 30 is free to travel through hose 14. Water will therefore fill tree stand 12 until the level of water within tree stand 12 is equal to the level of water within reservoir 30, since the atmospheric pressure pushing down through orifice 38 and opening 20 will be equal. Before the water levels within cup 24 and reservoir 30 are equal, orifice 38 provides pressure from the atmosphere to force the water within reservoir 30 through hose 14. Since the top of reservoir 30 in its side position is lower than the top of tree stand 12 by the sum of dimension B and dimension D, water will not overflow from tree stand 12 through opening 20. In normal use, water will evaporate from tree stand 12 and also will be consumed by the Christmas tree. As this happens, water from reservoir 30 will continuously flow into tree stand 12 until reservoir 30 is almost empty. While system 10 is in use, outer decorative enclosure 16 can be placed over reservoir 30 to conceal it, and make the Christmas tree scene more aesthetically pleasing.

When the water level in the reservoir 30 is low, it can be tilted in an upright position, as shown in phantom, and cap assembly 34 can be removed from reservoir 30. In this position, the top of fill spout 35 is above the top of tree stand 12 by dimension A such that hose 14 can be removed without water being drained out of tree stand 12. Cap assembly 34 generally includes a plug for closing hose 14 when it is not attached to reservoir 30, as will be described hereunder. Reservoir 30 can then be refilled, cap assembly 34 replaced, reservoir 30 tilted back on its side and outer decorative package 16 placed over reservoir 30. Therefore, a person watering a Christmas tree within tree stand 12 need not get near tree stand 12, and thus, the drawbacks associated with directly watering tree stand 12 can be avoided.

System 10 also provides a means by which tree stand 12 can be effectively emptied at the end of the holiday season before the Christmas tree is removed. To do this, reservoir 30 is first emptied by the same procedure in which it was filled as described above, and placed on its side as shown in FIG. 2. Since reservoir 30 is empty, and tree stand 12 will have water remaining in it, water from tree stand 12 will travel back through hose 14 into reservoir 30 until the water levels of tree stand 12 and reservoir 30 are equal as described above. Since spigot 36 of reservoir 30 is below the bottom surface of cup 24 by dimension E, all of the water within tree stand 12 can be drained back into reservoir 30. Accordingly, the Christmas tree with the tree stand 12 attached, can be removed from the Christmas location without any water remaining within stand 12. Therefore, the drawbacks of carrying a Christmas tree and attached stand with water in it can be avoided.

Figure 3:
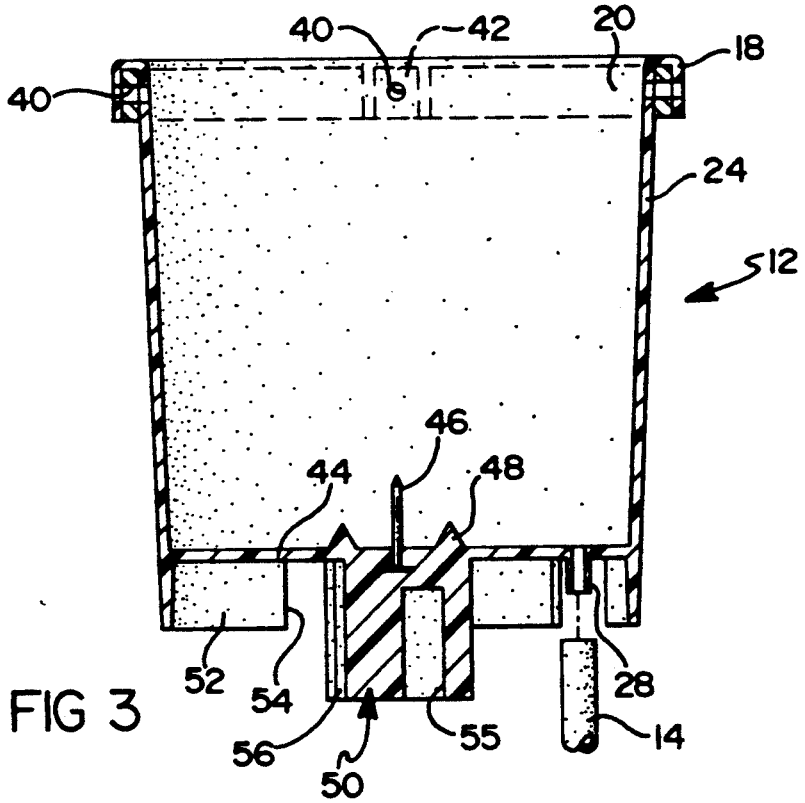
FIG. 3 is a cut-away view of the Christmas tree stand.

Now turning to FIG. 3, a cross-sectional view of cup 24 of tree stand 12 is shown. At an upper portion of cup 24 is lip 18 having cavities 40 for accepting eye bolts 22. Since cup 24 is generally a molded plastic, and thus threading metal eye bolts 22 into a plastic would not be affective, each cavity 40 is generally fitted with an internally threaded metal portion 42 in which eye bolts 22 can be threadably engaged. At a lower portion of cup 24 is a bottom plate 44. Projecting upward from bottom plate 44 within the inner chamber of cup 24 is a metal spike 46 at a general central location. Metal spike 46 provides an anchor point for which the bottom of the Christmas tree trunk can be secured to. Positioned around metal spike 46 is a plurality of integral plastic spike members 48 for providing additional stability to the Christmas tree. Generally, metal spike 46 will be configured in an appropriate location during the molding process of cup 24, and integral spike members 48 will be a molded part of cup 24. At an outer surface of bottom plate 44 is a projection 50 having a plurality of grooves 56 for accepting legs 26, described hereunder. In addition, projection 50 includes hollow portions 55 for reducing the amount of material needed to form tree stand 12. A skirt section 52 projects downward from the outer perimeter of plate 44. Skirt 52 further includes a number of slots 54 which each of the legs 26 projects through. Positioned through plate 44 and in communication with the inner chamber of cup 24 is spigot 28 for accepting hose 14 as described above.

FIG. 4 shows a bottom view of cup 24. As is apparent, grooves 56 are in the shape of a "T" and are aligned with slots 54. Projection 50 is integrally molded to bottom plate 44 and is generally cylindrical in shape having an appropriate diameter. Hollow portions 55 are generally "pie" shaped, and are separated by rib sections, as shown. Spigot 28 is positioned intermediate projection 50 and skirt 52, but can take virtually any position. Metal pieces 42 are positioned between lip 18 and the outer surface of cup 24. N o w turning to FIGS. 5A and 5B, a side view of one legs 26 is shown in FIG. 5A, and a bottom view of the same leg is shown in FIG. 5B. Each of legs 26 are generally of an injection molded truss style. At one end of leg 26 is a foot pad 62 which will generally rest on the floor. At the end opposite foot pad 62 is a T-shaped tongue 64 adapted to mate with one of the grooves 56 as shown in FIG. 4. T-shaped tongue 64 can be better visualized in FIG. 5B. Each of truss style legs 26 generally includes a top plate 61, a bottom plate 63, a middle plate 65 extending perpendicular to top and bottom plates 61 and 63, and truss supports 60, as shown.

Generally, leg 26 will be positioned within groove 56 by sliding T-shaped tongue 64 into groove 56 from a top surface of T-shaped tongue 64. Once T-shaped tongue 64 is positioned within groove 56, top surface 68 will rest against the outer surface of bottom plate 44, and bottom surface 66 of T-shaped tongue 64 will be substantially aligned with the bottom surface of projection 50. In this position, bottom surface 66 will be positioned slightly above the ground surface on which foot pad 62 is resting, even when a Christmas tree is positioned within the stand 12. This allows a small amount of flexure to ensure that the foot pad 62 of legs 26 contact the floor before the center projection 50 does to accommodate slightly uneven floor surfaces. Legs 26 are readily detachable from cup 24 to provide minimum storage and display space requirements.

FIG. 6 shows a blown-up perspective view of spout assembly 34. Spout assembly 34 includes spigot 36 having an integral disk 74 positioned proximate its center. At one end of spigot 36 is a plug 76 and at an end opposite plug 76 is tube 14 positioned in a detachable force fit, as described above. Positioned around disk 74 is an outer cap 72 having an internal threaded portion and a lip section 73. Lip section 73 contacts an outer perimeter of disk 74 when cap assembly 34 is assembled.

Hose 14 is first force fitted onto spigot 36 opposite plug 76. At this point lip section 73 of outer cap 72 is resting against the outer perimeter of disk 74. The end of spigot 36 having plug 76 is then inserted into threaded fill spout 35. Outer cap 72 is then threaded onto threaded fill spout 35 until disk 74 is forced up against an outer edge of threaded fill spout 35. As outer cap 72 is threaded onto threaded fill spout 35, spigot 36 is not twisted. When spout assembly 34 is removed from reservoir 30 to either fill or empty it as described above, outer cap 72 is unscrewed from fill spout 35 while reservoir 30 is an upright position and plug 76 is inserted into spigot 36 opposite hose 14. By this, hose 14 can be placed on the floor with cap assembly 34 attached to it without any water draining from tree stand 12.

Now turning to FIGS. 7A and 7B, a second cap assembly 80 is shown in a perspective view in 7A and a blown-up perspective view in 7B. Cap assembly 80 is comprised of an outer cap 82 having a threaded internal portion, a valve body 86 having an integral disk 84, a spigot 88 and a valve 92 inserted into an orifice 90. Valve 92 includes an orifice 96, valve handle 94 and an integral ring 98. Adjacent orifice 90 is a groove 99 within valve body 86. Valve 92 is inserted into orifice 90 of valve body 86 until ring 98 "snaps" into groove 99 located on the inner portion of orifice 90 of valve body 86. In this snapped configuration, valve 92 is positionable by turning of handle 94 in a rotary direction.

In operation, outer cap 82 is positioned around disk 84 of valve body 86 such that an outer lip 83 of outer cap 82 is adjacent an outer edge of disk 84. Outer cap 82 is then threaded onto threaded fill spout 35 as with spout assembly 34. Valve body 86 includes an internal channel which aligns the opening of threaded fill spout 35 with spigot 88. Orifice 96 of valve 92 traverses the entire width of valve 92. By this configuration, handle 94 can position orifice 96 of valve 92 to be aligned with the opening in threaded fill spout 35 and the opening in spigot 88 within the channel of valve body 86. Consequently, turning of handle 94 such that orifice 96 of valve 92 is perpendicular to the alignment of the opening in fill spout 35 and the opening in spigot 88 will prevent flow from opening 35 to spigot 88, or vice versa. By this, as above, outer cap 82 can be threadably disengaged from threaded fill spout 35 of reservoir 30 when valve 92 is in a closed position to prevent water in stand 12 from leaking out of hose 14. In addition, hose 14 is force fitted onto spigot 88 and as such can be entirely removed from spout assembly 80 when no water is in stand 12. Therefore, cap assembly 80 also acts as a completely closable cap for reservoir 30.

Now turning to FIG. 8, a second preferred embodiment of the present invention is shown generally at 100. Assembly 100 includes a tree stand 120 of the same basic design as that of tree stand 12 of FIG. 1, including a spigot (not shown) in a lower portion of tree stand 120. As above, tree stand 120 includes an upper lip portion 180 having a plurality of detachable eye bolts 220 for positioning a Christmas tree (not shown) in a like manner as to that of FIG. 1. In addition, a plurality of detachable leg members 260 are positioned to support tree stand 120. Assembly 100 includes the additional feature of having a clear tube 102 as a fluid level indicator. Tube 102 is connected at one end to the spigot, as described above, at the lower portion of tree stand 120, and is secured at an opposite end to an upper portion of tree stand 120. In FIG. 8, this end of clear tube 102 is forced between the inner surface of lip portion 180 and the outer surface of cup 240. Since the level of water within cup portion 240 will be at the same level as the water within clear tube 102, a visual indication of the amount of water within cup 240 can be attained without actually viewing the interior of cup 240.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A watering apparatus comprising:

a first reservoir including at a top end an open section and at an opposite end a spigot for accepting one end of a hose;

a second reservoir positioned remote from said first reservoir, said hose allowing a fluid material to travel between said first reservoir and said second reservoir; and a cap assembly selectively detachable from said second reservoir and having a spigot for accepting the opposite end of said hose, said cap assembly further having means for preventing the fluid material from flowing through said hose from said first reservoir when said hose is not connected to said second reservoir.

2. The watering apparatus according to claim 1 wherein said second reservoir further includes a decorative outer enclosure.

3. The watering apparatus according to claim 1 wherein said first reservoir includes a plurality of leg members, said leg members being selectively attachable to said first reservoir.

4. The watering apparatus according to claim 1 wherein said first reservoir is cylindrical and has a diameter of approximately 6½ inches.

5. The watering apparatus according to claim 3 wherein said plurality of legs are selectively attachable to said first reservoir by means of a T-shaped tongue on the legs and a T-shaped groove located at a base portion of said first reservoir.

6. The watering apparatus according to claim 5 wherein said spigot of said second reservoir includes a disk portion for securing said cap assembly to said second reservoir by means of an outer threadable cap, said spigot further including a first end for accepting said hose in a force fit and a second end having a plug for positioning within said spigot to prevent flow of said fluid material.

7. The watering apparatus according to claim 6 wherein said cap assembly includes a valve, said valve being positionable from a first position to prevent flow of fluid through said hose to a second position enabling flow of fluid through said hose.

8. The watering apparatus according to claim 1 wherein said second reservoir includes a pressure equalizing orifice.

9. The watering apparatus according to claim 1 wherein the first reservoir includes a bottom surface, and further wherein the spigot of the second reservoir is positioned at a lower position than the bottom surface of the first reservoir.

10. A Christmas tree watering apparatus comprising:

a Christmas tree stand defining a chamber and including an opening into said chamber for accepting a Christmas tree, a bottom portion of said chamber including means for selectively engaging a plurality of legs, said bottom portion further including an orifice in communication with the chamber of said Christmas tree stand;

a remote reservoir including a first opening in communication with an internal chamber of the remote reservoir, said first opening including a threaded orifice and a cap assembly threadably engageable with said orifice, said cap assembly including a spigot;

a hose having a first end and a second end, said first end of said hose connected to said orifice of said Christmas tree stand and said second end of said hose connected to said first opening in communication with the internal chamber of said remote reservoir through said spigot in said cap assembly; and a decorative outer enclosure, said outer enclosure selectively positionable around said remote reservoir.

11. The Christmas tree watering apparatus according to claim 10 wherein said orifice in communication with the chamber of said Christmas tree stand is a spigot attached to a bottom surface of said Christmas tree stand, said first end of said hose being forced fit onto said spigot.

12. The Christmas tree watering apparatus according to claim 10 wherein said cap assembly further includes a valve positionable between a first position and a second position, said first position allowing flow of fluid material between said hose and said internal chamber of said remote reservoir, and said second position preventing flow of fluid material between said hose and said internal chamber of said remote reservoir.

13. The Christmas tree watering apparatus according to claim 10 wherein said cap assembly includes a plug positionable within said spigot of said cap assembly to prevent flow of fluid material between said hose and the internal chamber of said remote reservoir.

14. The Christmas tree watering apparatus according to claim 10 wherein said Christmas tree stand includes means for selectively engaging said legs, spike means for rigidly positioning said Christmas tree and eye bolt means for engaging said Christmas tree.

15. The Christmas tree watering apparatus according to claim 14 wherein said means for selectively engaging said legs are T-shaped tongues and grooves.

16. The Christmas tree watering apparatus according to claim 10 further comprising means for preventing flow of a fluid material between said remote reservoir and said hose.

17. The Christmas tree watering apparatus according to claim 10 wherein said decorative outer enclosure includes a bow.

18. The Christmas tree watering apparatus according to claim 10 wherein said remote reservoir includes a handle and a second opening in communication with the internal chamber of the remote reservoir.

19. A watering apparatus comprising:

a first reservoir including at a top end an open section and at an opposite end a first opening for accepting one end of a hose;

a second reservoir positioned remote from said first reservoir, said second reservoir including a cap assembly selectively detachable from said second reservoir, said cap assembly including a second opening for accepting the opposite end of the hose, said hose allowing a fluid material to travel between said first reservoir and said second reservoir; and means for preventing the fluid material from flowing through said hose from said first reservoir when said hose is not connected to said second opening.

20. The watering apparatus according to claim 19 wherein said second reservoir further includes a decorative outer enclosure.

21. The watering apparatus according to claim 14 wherein said first reservoir includes a plurality of leg members, said leg members being selectively attachable to said first reservoir.

22. The watering apparatus according to claim 19 wherein said first reservoir is cylindrical and has a diameter of approximately 6½ inches.

23. The watering apparatus according to claim 21 wherein said plurality of legs are selectively attachable to said first reservoir by means of a T-shaped tongue on the legs and a T-shaped groove located at a base portion of said first reservoir.

24. The watering apparatus according to claim 19 wherein said second opening of said second reservoir includes a disk portion for securing said cap assembly to said second reservoir by means of an outer threadable cap, said second opening further including a first end for accepting said hose in a force fit and a second end having a plug for positioning within said second opening to prevent flow of said fluid material.

25. The watering apparatus according to claim 19 wherein said cap assembly includes a valve, said valve being positionable from a first position to prevent flow of fluid through said hose to a second position enabling flow of fluid through said hose.

26. The watering apparatus according to claim 19 wherein said second reservoir includes a pressure equalizing orifice.

27. The watering apparatus according to claim 19 wherein said second opening of the second reservoir is positioned at a lower position than the bottom surface of the first reservoir.

28. The watering apparatus according to claim 19, further comprising a substantially clear hose operable to provide an indication of the amount of fluid material within at least a portion of said watering apparatus.

* * * * *

UNITED STATES PATENT AND TRADEMARK OFFICE

CERTIFICATE OF CORRECTION

PATENT NO. : 5,201,140
DATED : April 13, 1993
INVENTOR(S) : Donald P. Voorhis

It is certified that error appears in the above-indentified patent and that said Letters Patent is hereby corrected as shown below:

Column 1, line 31, "a" should be --an--.

Column 3, line 18, before "see" insert --(--.

Column 4, line 7, "ca" should be --cap--.

Column 5, line 21, "affective" should be --effective--.

Column 5, line 54, "N o w" should be --Now--.

Column 5, line 55, "legs" should be --leg--.

Column 9, line 34, Claim 21, "14" should be --19--.

Signed and Sealed this

Sixth Day of September, 1994

*Attest:*

*Attesting Officer*

BRUCE LEHMAN

*Commissioner of Patents and Trademarks*